US009320407B2

(12) United States Patent
Policicchio et al.

(10) Patent No.: US 9,320,407 B2
(45) Date of Patent: Apr. 26, 2016

(54) FLOOR CLEANING APPLIANCE HAVING DISPOSABLE FLOOR SHEETS AND METHOD OF CLEANING A FLOOR THEREWITH

(75) Inventors: Nicola John Policicchio, Mason, OH (US); Jeff Scholten, Ada, MI (US); Joe White, Grand Rapids, MI (US)

(73) Assignee: The Procter & Gamble Company, Cincinnati, OH (US)

( * ) Notice: Subject to any disclaimer, the term of this patent is extended or adjusted under 35 U.S.C. 154(b) by 957 days.

(21) Appl. No.: 13/487,696

(22) Filed: Jun. 4, 2012

(65) Prior Publication Data

US 2013/0319463 A1 Dec. 5, 2013

(51) Int. Cl.

| | |
|---|---|
| ***A47L 13/34*** | (2006.01) |
| ***A47L 13/22*** | (2006.01) |
| *A47L 13/17* | (2006.01) |
| *A47L 13/19* | (2006.01) |
| *A47K 7/03* | (2006.01) |

(52) U.S. Cl.

CPC ..... *A47L 13/225* (2013.01); *A47K 7/03* (2013.01); *A47L 13/17* (2013.01); *A47L 13/19* (2013.01)

(58) Field of Classification Search

CPC ..... A47L 13/225; A47L 1/15; A47L 13/17; A47L 13/19; A47K 7/03

USPC ..... 15/320

IPC ..... A47L 11/34

See application file for complete search history.

(56) References Cited

U.S. PATENT DOCUMENTS

| | | | | |
|---|---|---|---|---|
| 4,191,609 | A | 3/1980 | Trokhan | |
| 4,637,859 | A | 1/1987 | Trokhan | |
| 5,960,508 | A | 10/1999 | Holt et al. | |
| 6,048,368 | A | 4/2000 | Tcheou et al. | |
| 6,101,661 | A | 8/2000 | Policicchio et al. | |
| 6,305,046 | B1 | 10/2001 | Kingry et al. | |
| 6,386,392 | B1 | 5/2002 | Argentieri et al. | |
| 6,716,805 | B1 | 4/2004 | Sherry et al. | |
| 6,797,357 | B2 | 9/2004 | Fereshtehkhou et al. | |
| 6,936,330 | B2 | 8/2005 | Fereshtehkhou et al. | |
| 7,144,173 | B2 | 12/2006 | Policicchio et al. | |
| D588,770 | S | 3/2009 | Koenig et al. | |
| 8,186,898 | B2 | 5/2012 | Bradbury et al. | |
| 2002/0166573 | A1 | 11/2002 | Policicchio et al. | |
| 2005/0081888 | A1 | 4/2005 | Pung et al. | |
| 2007/0020020 | A1 | 1/2007 | Bobrosky et al. | |
| 2009/0000051 | A1 | 1/2009 | Rosenzweig et al. | |
| 2013/0055517 | A1* | 3/2013 | McKiernan | C11D 17/049 15/104.93 |
| 2014/0053870 | A1* | 2/2014 | Tuman | A47L 13/16 134/6 |

OTHER PUBLICATIONS

PCT International Search report dtd Dec. 4, 2013; 10 Pages.

* cited by examiner

*Primary Examiner* — David Redding

(74) *Attorney, Agent, or Firm* — Larry L. Huston; Steven W. Miller

(57) ABSTRACT

A cleaning system. The system has a steam mop, pad, and a cleaning solution. This combination provides synergistic cleaning benefits over prior art systems using steam alone and over prior art systems using cleaning solutions alone. The cleaning benefits include both the capability to clean larger areas and clean additional types of stains. The cleaning system may be used to clean hard surfaces, such as a floor.

17 Claims, 4 Drawing Sheets

FLOOR CLEANING APPLIANCE HAVING DISPOSABLE FLOOR SHEETS AND METHOD OF CLEANING A FLOOR THEREWITH

FIELD OF THE INVENTION

The present invention relates to appliances and floor sheets usable to clean a floor and more particularly to such appliances and floor sheets having chemistry, thermal energy and steam to assist in cleaning a floor or other hard surface.

BACKGROUND OF THE INVENTION

Cleaning of hard surfaces, such as floors (vinyl, linoleum, tile, cement), countertops, showers, etc. is well known in the art. Cleaning may be accomplished using cellulosic paper towels and non-woven sheets, as are well known in the art. Nonwoven sheets may be made according to commonly assigned U.S. Pat. Nos. 6,936,330 and/or 6,797,357. Cellulosic paper towels may be made according to commonly assigned U.S. Pat. Nos. 4,191,609 and/or 4,637,859.

Such sheets have been removably attached to manual implements. The implements increase reach, and improve ergonomics. For example, when the hard surface to be cleaned is a floor, the implement allows the user to clean from a standing position, improving comfort over cleaning from a crouched position or on the knees. Manual implements may be made according to commonly assigned U.S. Pat. Nos. 6,305,046 and/or D588,770.

To improve cleaning of soluble stains, wetted and wettable floor sheets have been used. Pre-wetted floor sheets include those having APG polymers, as disclosed in commonly assigned U.S. Pat. No. 6,716,805. Wettable floor sheets have been used with the commercially available Swiffer WetJet (R) appliance. This appliance sprays cleaning solution onto the floor from a replaceable reservoir, as described in commonly assigned U.S. Pat. No. 8,186,898. Cleaning solution chemistry and a reservoir therefor may be made according to commonly assigned U.S. Pat. No. 6,386,392. Floor sheets which absorb cleaning solution from the floor may be made according to commonly assigned U.S. Pat. Nos. 5,960,508, 6,101,661 and/or 7,144,173.

Even with the cleaning solution, tough stain removal may still be limited, for example when cleaning certain types of dried down chunky foods spills. One attempt to further clean tough stains is to include a dedicated scrubbing strip. For example Swiffer Wet Floor sheets have a textured green scrubbing strip disposed on the pad and made according to commonly assigned US 2005/0081888 A1. Such scrubbing strips are discarded with each pad after use. In contrast the WetJet appliance uses a scrubbing strip attach on front edge of the appliance and which is re-used throughout several floor sheets. While these features do improve scrubbing ability, they have the inconvenience of requiring the user to flip the mop head to engage the scrubbing strip with the stain. Furthermore, stains comprising mixed components of sugar, grease and protein, may require excessive scrubbing to completely remove the stain.

Yet another attempt to clean stains from textile fabrics utilizes an absorbent layer placed over the stain. Under heat, pressure, steam the stain may be absorbed into the absorbent layer, as disclosed in commonly assigned U.S. Pat. No. 6,048,368.

But cleaning solution, interposed absorbent layer and scrubbing strips may not effectively clean all stains. For example, kitchen stains may contain sugar, grease and protein. Many cleaning solutions do not effectively handle this type of stain. Accordingly, steam assisted appliances are used to clean such stains.

Floor cleaning steam appliances are well known in the art. Commercially available steam appliances advertise the ability to be able to clean stains without the use of chemicals, by harnessing the energy in the steam. All commercially available steam appliance known to Applicant describe use with a durable, washable floor sheet. The floor sheet is typically a textile micro-fiber or terry cloth.

Commercially available floor cleaning steam appliances include: SHARK, SHARK s3501 STEAM POCKET, SHARK s3251 LITE AND EASY and SHARK s3901 LIFT AWAY PRO, BISSELL STEAM APPLIANCE SELECT, STEAM AND SWEEP HARD FLOOR(adds beater brush), STEAM AND SWEEP PET (adds rubber), BLACK & DECKERSM1620, ORECK STEAM IT, STEAM 100, EUREKA ENVIRO steamer 313A, BIONAIRE 22499, STEAM FAST SF-140, STEAMBOY T1 and SHARPTEK. While these appliances vary in the amount of steam output, mop head shape, and location of the reservoir, all have two common characteristics. The cleaning pad is a washable micro-fiber cloth and use ordinary water dosed from a reservoir (18) to form the steam.

Durable micro-fiber floor sheets, other such cleaning pads offer high surface area, absorbency and mechanical scrubbing capability. These attributes may be helpful when cleaning is achieved with steam and the steam condenses to water. For example, US 2009/0000051 A1, to Rosenzweig, filed Mar. 7, 2008 describes a fabric steam pad with a removable fastener for use with a steam appliance.

But textile microfiber floor sheets encounter problems when used with a steam appliance. For example, such floor sheets require inconvenient washing between uses. Sometimes, the high surface area of the microfiber pad often traps dirt so tightly, that it cannot be easily washed out. Even so, the microfiber pad can lose efficacy after only few cleaning jobs. Thus, the common textile/microfiber/reusable floor sheet commonly used with a steam appliance has several problems.

But such textile floor sheets have even more problems. For example when used with a steam appliance, the floor sheet is dry and requires priming. Priming requires the user to dose steam into the pad for several minutes in order to wet the floor sheet enough to start cleaning process. Priming is inconvenient and requires the user to waste time while waiting sufficient saturation of the floor sheet. Even when primed, the floor sheet may be unevenly wetted, and thus less efficacious than when evenly wetted.

Steam delivered via steam appliance offers the advantage of being able to soften and in some case even dissolve some tough, stuck on soils such as dried chunky food spills. Steam also offers a safe low residue alternative for sanitizing versus other systems that require high levels of chemical actives to sanitize/disinfect.

However, steam has the problem of inefficiently cleaning everyday greasy particulate soils, often found across larger areas of a floor. This problem occurs when steam applied to the pad condenses to water. This water can aide in hydrating the stain to loosen some greasy particulates. However, without detergent, polymer or other wetting agent, the ability of water (even hot water) to suspend particulate, particularly insoluble particulates, is limited. Furthermore, even if the heated condensed water formed by steam can initially wet the floor, the stain quickly cools down and becomes inefficacious.

Since water has high surface tension (73.8 dynes/cm2 at 20 C) compared to many cleaning solutions (35 to 40 dynes/cm 2 at 20 C), water can de-wet the floor leaving wet lines. Upon drying these lines can leave visible streaks. Visual streaks can be a common complaint among users of steam appliances.

Thus, the problem of cleaning floor stains not efficaciously cleaned by dry sheets, wet/wettable floor sheets, and with steam assisted textile sheets persists.

SUMMARY OF THE INVENTION

The invention comprises a cleaning system. The system has a steam appliance, a pad, and a cleaning solution. The pad may be pre-wetted with the cleaning solution.

DETAILED DESCRIPTION OF THE INVENTION

The invention comprises a cleaning system. The cleaning system comprises a steam generating appliance (10), water or other cleaning solution therefor, disposable pads (20) usable therewith and cleaning solution disposed on the pads (20).

Figure 1:
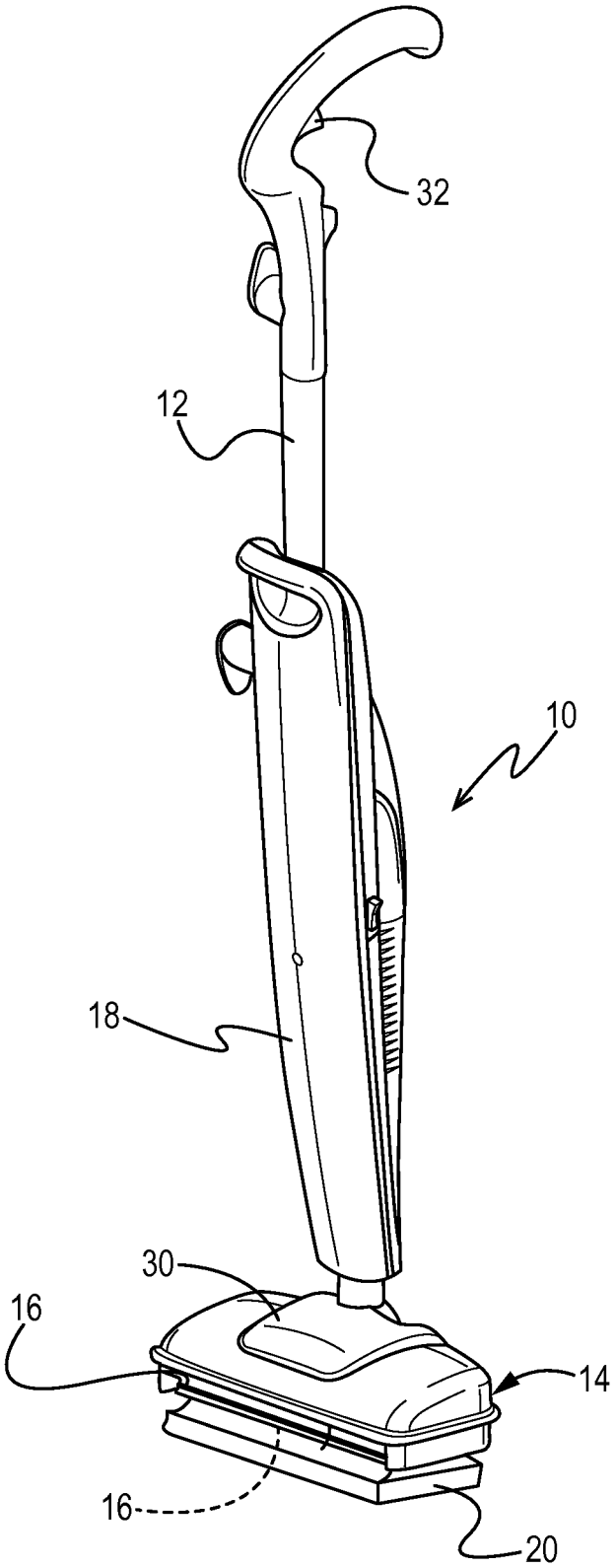
FIG. 1 is a perspective view of an appliance usable with the present invention.

Referring to FIG. 1, the invention may comprise a surface cleaning apparatus, such as a steam generating appliance (10). The appliance (10) may comprise a handle (12) and foot (14) mounted thereto in pivoting or multi-axially swiveling relationship. Alternatively, if a small hand-held appliance (10) is desired, the handle (12) and foot (14) may be disposed in fixed relationship, so that countertops, showers and similar surfaces may be cleaned.

The appliance (10) may comprise a reservoir (18) for receiving water or cleaning solution. The cleaning solution may be aqueous. The reservoir (18) may be permanently attached to the appliance (10) and refilled from a tap or larger supply. Alternatively, the reservoir (18) may be removed from the appliance (10) and refilled or replaced with a new reservoir (18) containing the desired cleaning solution. The same cleaning solution may be used for successive tasks. Alternatively, the cleaning solution may be adjusted to suit a particular task.

The reservoir (18) may be mounted on the handle (12) of the appliance (10), This arrangement provides the benefit of gravity flow to the foot (14), if desired. Such an arrangement is shown in U.S. Pat. No. 6,990,708. Alternatively, the reservoir (18) may be mounted in the foot (14). This arrangement provides the benefit of lowering the center of gravity of the appliance (10).

Optionally, the appliance (10) may further comprise a vacuum, to removed debris from the floor. The vacuum may be fan powered, and provide for delivery of lose debris to a dirt bin. The dirt bin may be mounted on the handle (12) of the appliance (10), as disclosed in U.S. Pat. No. 7,137,169. If a vacuum system is used, the vacuum system may have a pivoting nozzle to allow access to sheet grippers, as disclosed in U.S. Pat. No. 7,293,322. The sheet grippers may comprise resilient fingers as shown in commonly assigned U.S. Pat. Nos. 6,305,046, 6,484,346 and 6,651,290.

Optionally, the appliance (10) may further comprise an axially rotatable beater bar, to removed debris from the floor. The beater bar may be electrically powered, in similar fashion as the steam generator. The beater may sweep loose debris into a dirt bin, as described in 2010/0287716.

The appliance (10) may further comprise a steam generator. The steam generator may be mounted in the foot (14), or on the handle (12). The steam generator converts electric energy to heat. The heat, in turn, converts water or cleaning solution to steam. The steam generator may be corded, powered by disposable batteries or powered by rechargeable batteries. The steam generator may be mounted on the handle (12) or on the foot (14).

The steam generator may comprise one or more heated plates which flash the water or other cleaning solution deposited thereon to steam. Alternatively, water may be transferred to steam using coils, as described in U.S. Pat. No. 1,840,690, issued Jan. 12, 1932. One or more steam distributors may direct the steam to the floor sheet (20), and optionally directly to the floor. The steam distributor may comprise a manifold taking the steam from the source of generation to terminate in one or more nozzles. The nozzles may comprise one or more slits, small openings, large holes, apertures and/or any combination thereof.

The nozzles may distribute the steam to a sole plate (16). The bottom of the sole plate (16) may be juxtaposed with the floor or other target surface in use. The floor sheet (20) may be removably attached to the sole plate (16), in order to both receive steam from the appliance (10) at the upper surface of the floor sheet (20) and transfer the steam to the target surface at the lower surface of the floor sheet.

If desired, the steam generating appliance (10) may further include a shuttle. The shuttle directs steam to different portions of the foot (14), and ultimately to different portions of the floor sheet (20). Such an appliance (10) may be made in accordance with US 2011/0131753, published Jun. 9, 2011.

The appliance (10) may include a trigger (32) or switch, typically mounted on the handle (12). This trigger (32) or switch allows fluid from the reservoir (18) to be transferred to the steam generator, in known fashion, so that the user may does a desired amount of steam in response thereto. If the appliance (10) uses a pump to transfer fluid to the steam generator, the switch may complete a circuit, activating the pump. Likewise, if a gravity flow system is utilized, the switch may open a valve, allowing gravity flow. Alternatively, a trigger (32) pump may be used, as is known in the art.

A typical steam appliance (10) can dose about 20 mls/minute of water onto the heater. Of this amount, about 5 mls/min evaporate as steam before reaching the pad (20). Another 6 mls/minute can escape as steam out the edges of the pad (20). These losses leave about 9 mls/min of steam which can condense into water onto the pad (20) being tested. Thus, for each 1 sqm cleaned, about 2-3 mls of condensed water may be added to a pre-moistened pad (20) during use to replenish moisture lost during use.

Figure 2:
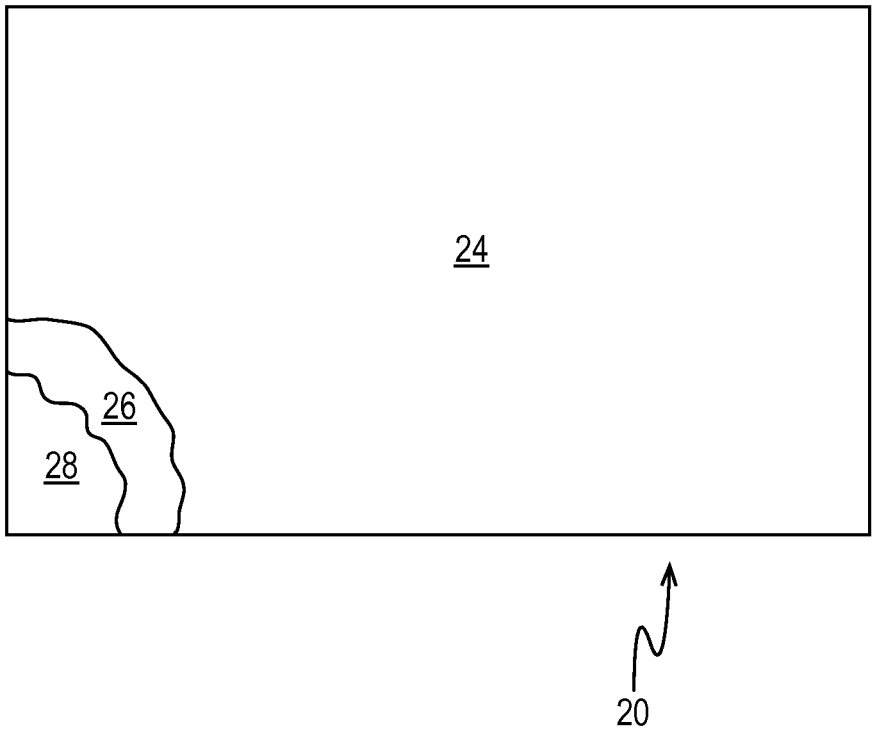
FIG. 2 is a top plan view, shown partially in cutaway of a pad/floor sheet according to the present invention.

Referring to FIG. 2, the floor sheet (20) usable with the present invention may comprise a laminate construction. The laminate may comprise at least one floor contacting layer and at least one absorbent, reservoir storage layer (26). A third, dedicated foot contacting layer is optional and can be used for attachment to the appliance (10). Thus, the floor sheet (20) of the present invention may comprise 1, 2, 3, 4 or more layers.

When a multi-laminate structure is used, the outer pre-moistened floor contacting layer may contain at least about 30% hydrophobic fibers for oil remove and glide on floors. The floor contacting layer may comprise a polyolefinic, discrete apertured nonwoven. This nonwoven may comprise carded, spunbonded, and/or meltblown fibers.

Materials useful in the floor contacting layer may be sufficiently durable to retain integrity during the cleaning process. In addition, when the cleaning pad (20) is used in combination with a solution, the floor contacting layer may be capable of absorbing liquids and soils, and relinquishing those liquids and soils to the storage layer (26). This transfer ensures the floor contacting layer will be able to remove additional material from the surface being cleaned.

The floor contacting layer can be a mono-layer, or a multi-layer structure. One or more plies of the floor contacting layer can be slitted to facilitate scrubbing of the soiled surface and the uptake of particulate matter. This floor contacting layer, as it passes over the soiled surface, interacts with the soil (and cleaning solution when used), loosening and emulsifying tough soils and permitting them to pass freely into the storage layer (26) of the pad (20). The floor contacting layer may contain openings (e.g., slits, apertures) that provide an easy avenue for larger particulate soil to move freely in and become entrapped within the storage layer (26) of the pad (20). Low density structures are useful as the scrubbing layer, to facilitate transport of particulate matter to the storage layer (26).

In order to provide desired integrity, materials particularly suitable for the floor contacting layer include synthetics such as polyolefins (e.g., polyethylene and polypropylene), polyesters, polyamides, synthetic cellulosics (e.g., Rayon), and blends thereof. Such synthetic materials can be manufactured using known process such as carded, spunbond, meltblown, airlaid, needle punched and the like. In one embodiment the floor contacting layer may comprise 50 gsm, 80:20 PP/Rayon nonwoven material.

The storage layer (26) may be joined in face to face relationship with the floor contacting layer. The storage layer (26) may comprise treated or untreated cellulose, either as a standalone material or as a hybrid with hydrophobic fibers. The hydrophobic content of the storage layer (26) may be less than about 30%, orless than about 20% by weight of the total fiber content of that storage layer (26). The storage layer (26) may comprise air-laid cellulose. The storage layer (26) may have a basis weight ranging from 30 to 1000 gsm, more particularly from 100 to 500 gsm and more particularly from 100 to 300 gsm. In one embodiment, the storage layer (26) may comprise airlaid pulp and bicomponent fibers with a basis weight of 135 gsm.

The floor sheet (20) may further comprise a foot contacting layer. The foot contacting layer may be a relatively open nonwoven. This nonwoven may function as a loop attachment system if hook fasteners are selected for the bottom of the foot. This layer may also assist in distributing steam from the opening of the manifold throughout the pad (20). In one embodiment the foot contacting layer may comprise 50 gsm, 100% PP HET spunbond material.

Suitable embodiments for pad (20) constructions are disclosed and referenced in U.S. Pat. Nos. 6,716,805 B1 and 7,420,656 B2 granted to Sherry/Policicchio Apr. 6, 2008. A pad (20) is any removable, disposable generally planar sheet which can accept steam and be used with steam to remove stains from a target surface, with or without the assistance of a cleaning solution, although the pad (20) described and claimed as part of the system herein may advantageously accept and distribute cleaning solution to assist in cleaning. A particular form of a pad (20) is a floor sheet (20), when used therefor. The terms pad (20) and floor sheet (20) will be used interchangeably, unless otherwise indicated. The present system does not rely upon, and can specifically be used without interposing a fabric or other layer between the pad (20) and the stain to be cleaned.

Alternatively, the pre-moistened pad (20) may utilize a single layer (i.e., similar to a wipe), the substrate of such a pad (20) may comprise fibers, more particularly a combination of hydrophilic and hydrophobic fibers, and more particularly a combination having at least about 30% hydrophobic fibers, or at least about 50% hydrophobic fibers in a hydroentangled web. By hydrophobic fibers, it is meant polyester fibers as well as those fibers derived from other polyolefins such as polyethylene, polypropylene and the like.

Various methods can be used to form a suitable fibrous web for use in the pad (20) of the present invention. Such a web can be made by nonwoven dry forming techniques, such as air-laying, or alternatively by wet laying, such as on a paper making machine. Other non-woven manufacturing techniques, including but not limited to techniques such as melt blown, spunbonded, needle punched, and hydroentanglement methods can also be used.

In one embodiment, the dry fibers can be an airlaid nonwoven web comprising a combination of natural fibers, staple length synthetic fibers and a latex binder. The dry fibrous web can be about 20 to 80 percent by weight wood pulp fibers, 10 to 60 percent by weight staple length polyester fibers, and about 10 to 25 percent by weight binder. The dry floor sheet (20) can have a basis weight between about 30 and about 1000 grams per square meter.

The floor sheet (20) may be generally rectangular, and sized to removably fit on the sole plate (16) of the appliance (10). The floor sheet (20) may have two opposed faces, an upper face to receive steam, and a lower face which contacts and cleans the target surface through transfer of steam and/or cleaning solution thereto. The floor sheet (20) can function as a scrubbing layer or have additional materials added for scrubbing.

The floor sheet (20) may particularly not contain an imperforate film, such as is commonly used for backsheets of pads (20) in the art. An imperforate film will inhibit, if not prevent, transmission of steam therethrough, reducing efficacy of the cleaning system.

The floor sheet (20) may be disposable after a single use. By disposable, it is meant that the pad (20) is discarded after a single use of cleaning at least 5, 10, 15, 20 or more square meters and is not laundered or restored.

While steam generating appliances (10) have been designed to essentially clean with only steam, the inventors have surprisingly discovered significant synergy can be achieved when the three elements of steam, limited use disposable pads (20) and a cleaning solution are combined into a system. This combination creates a cleaning system that addresses floor cleaning requirements from tough, stuck on soils, to removing everyday particulate soils without leaving streaks in a consistent way, to providing hygiene/sanitization in a low chemical/low residue manner. The system of the present invention was also found to deliver an even greater olfactory experience for the user by combining heat from steam and perfume components from cleaning chemistry in pad (20) than occurs on pads (20) not having steam or heat assist.

The cleaning solution may be used with the floor sheets (20), such that the floor sheets (20) are pre-wetted as presented to the user. The floor sheet (20) may be fully impregnated with the cleaning solution or the solution may be applied on a lesser grams per gram basis. The floor sheets (20) may be disposed, transported, sold and stored in a liquid-tight thermoform tub, as is well known in the art. The floor sheets (20) may be disposed into the tub dry, the cleaning solution added thereafter and distributed throughout, as is known in the art.

The cleaning solution may comprise ordinary tap water with no other additives, or may further comprise an optionally aqueous composition having the following components, based upon weight percentages:

water 80 to 99.9%
surfactant 0.025 to 10%
agglomerating polymer 0.025 to 10%
and perfume 0.001 to 0.55%

The cleaning solution/floor sheet (20) may be made according to: 1) U.S. Pat. No. 6,716,805 B1 to Sherry/Policicchio Apr. 6, 2008 describing suitable cleaning compositions usable with pre-moistened pads (20) where no-rinse cleaning is desired; 2) U.S. Pat. No. 7,420,656 B2 to Sherry/Policicchio Dec. 30, 2008 describing suitable embodiments for cleaning substrates and cleaning chemistries and 3) publication 2011/0197382 filed Apr. 26, 2011, to inventor A.E. Sherry describing zwitterionic polymers and copolymers for use in providing soil agglomeration benefits for both dry and pre-moistened pads (20). Particularly, agglomerating polymers, such as Mirapol, available from Rhodia, may be utilized in the cleaning solution.

Pre-moistened pads (20) used in the system of the present invention are particularly advantageous in that they are always and instantaneously ready for use, and simple to use without special dosing. The user does not have to worry about applying too much cleaning solution, leading to waste, or too little cleaning solution to be efficacious.

When used with a conventional non-steam appliance (10) system the pads (20) may advantageously be over-saturated with the cleaning solution. By over-saturated, it is meant that the pads (20) are loaded with at least 2, 3, 4, 5, 6, 7, but not more than 15, 14, 13, 12, 11 or 10 grams of cleaning solution for each gram weight of the pad (20). This load factor is judged advantageous, particularly at a 7× or greater grams per gram load factor to deliver floor cleaning for large areas.

But a common problem with over-saturation is inconsistent cleaning performance, particularly during the first one to 2 sqm of floor area being cleaned. Furthermore, many cleaning solutions use about 0.1% total non-volatile cleaning agents including surfactants, polymers, preservatives, and suds suppressors. The amount of non-volatile cleaning agents may be tailored, to minimize floor from drying with too much actives thereon, which can leave sticky residue.

The ability of a pre-wetted floor sheet (20) to uniformly wet a floor is a desirable attribute to minimize solution de-wetting, which, in turn, can lead to undesirable streaks. Chemical actives typically considered are non-volatiles which can dry down into a residue. Volatile actives or VOC's are any organic compound having an initial boiling point less than or equal to 250° C. measured at a standard atmospheric pressure of 101.3 kPa. These actives typically evaporate, and therefore are less relevant for evaluation than compounds which do not evaporate so easily. Perfumes are also typically excluded, due to containing large amounts of VOC's. A pre-moistened pad (20) with about 0.1% non-volatile cleaning actives (excluding perfume & VOC's), may deliver between 2 to 4 mls per each 1 sqm of floor surface to provide effective cleaning.

In US 2011/0197382 A1 patent application filed Apr. 26, 2011, inventor A.E. Sherry describes suitable use of zwitterionic polymers and copolymers to provide soil agglomeration benefits for both dry and pre-moistened pads (20). In embodiments where these actives are applied in pre-moistened format, A.E. Sherry describes how these polymers have two ends wherein one has a strong positive charge and the other end has strong negative charge. At a neutral pH the charges are most balanced. Sherry also describes how the positive charge on the polymer can bind with the negative charge on the pad (20) provided by the —OH hydroxyl groups in the cellulosic component, should cellulose be used in the floor sheet (20) of the present invention.

For pads (20) used with steam appliance (10), polymers which remain attached to the pad (20) can be advantageous as they will be less affected by the dilution affects of condensed steam, thus remaining active at higher concentrations. As such the same formulations and cleaning actives described in 2011/0197382 A1 can even be more advantageous when used with a pad (20) in conjunction with a steam appliance (10).

In an alternative embodiment, an aqueous cleaning solution used with the floor sheet (20) may comprise peroxygen compound and a surfactant system. Suitable peroxygen compounds include hydrogen peroxide and T-butyl and hydroperoxide. The surfactants may be anionic, cationic, nonionic, zwitterionic, amphoteric, or any combinations thereof. Such a cleaning solutionmay be made according to U.S. Pat. No. 7,718,593 issued May 18, 2010.

While the embodiment described above for use with a steam-delivering appliance (10), uses a pre-moistened or pre-wetted pad (20), an alternative embodiment could utilize a dry cleaning solution. This embodiment utilizes similar pad (20) and similar cleaning actives which have been dried onto that pad (20) or has dry particulate material disposed on the substrate of the pad (20). While this pad (20) does have the inconvenience of requiring condensed steam priming before use, this embodiment also provides the benefit of less costly packaging.

A suitable solution or chemical containing dry pad (20) could include low residue non-ionic surfactants. Non-limiting examples of suitable non-ionic surfactants include alcohol alkoxylates, alkyl polysaccharides, amine oxides, block copolymers of ethylene oxide and polypropylene oxide, fluoro surfactants and silicone surfactants. At least one of the non-ionic surfactants may be an alkyl polysaccharide such as those described in U.S. Pat. Nos. 4,565,647, 5,776,872, 5,883,062 and 5,906,973. Among these alkyl polyglycosides, five and/or six sugar rings are believed to be efficacious.

If using an aqueous solution in a pre-moistened pad (20) is desired, the amount of surfactants can range from about 0.01 to about 0.5 w % and particularly from about 0.02 to 0.25 w % of the cleaning solution. If applying surfactants and drying the surfactant onto a dry chemical containing pad (20), a suitable level is 0.02 g to 0.2 g surfactant per pad (20) and more particularly from about 0.04 to about 0.1 g per pad (20) for a pad (20) having a floor contacting area having rectangular dimensions of 24-26 cm, particularly about 25 cm, by 9 to 11 cm, particularly 10 cm, yielding a floor contacting area of 25 square cm, ±10 percent.

A suitable cleaning solution for a dry or pre-wetted pad (20) in accordance with the present invention may include at least one agglomerating and/or wetting polymer. Suitable polymers include DADMAC/acrylic acide/acrylamide copolymer;DADMAC/maleic acide copolymer: DADMAC/sulfonic acid copolymer: with the DADMAC/acid monomer molar ratio being between 60:40 to 5:95, or from 50:50 to 10:90. Agglomerating polymers can comprise polyacrlamide such as Mirapol® Surf-S polymers made by Rhodia, Hyperfloc® made by HyChem Inc and polyethyleneimine such as Lupasol® polymers made by BASF. These polymers can alternatively or additionally be incorporated directly into the floor sheet (20) or the cleaning solution.

If using a aqueous solution in pre-moistened pad (20) format, or in spray format, suitable levels of agglomerating polymers can range from 0.02 to 1 w % and more particularly from 0.04 to about 0.5 w % of the cleaning solution. If applying polymers and drying down onto a dry chemical containing pad (20), the pad (20) may contain 0.02 g to 0.5 g agglomerating polymer per pad (20) and more particularly from 0.04 to 0.25 g agglomerating polymer per pad (20).

Optional ingredients include preservatives, suds suppressors, chelants, anti-bacterial agents, disinfectants, volatile cleaning actives such as solvents and adjuvants such as perfumes.

In yet another embodiment, the appliance (10) may spray the cleaning solution onto the floor or other target surface. This arrangement provides the benefit that the user can see where the cleaning solution is being applied, with it being blocked under the floor sheet (20). The cleaning solution may be any of the liquid solutions described above, aqueous or otherwise.

The sprayer may be a pump system, as described with respect to commonly assigned U.S. Pat. No. 8,186,898, or a gravity feed system, either permanently/removably attached to the appliance (10) or a part thereof. Or a separate aerosol or trigger (32) pump sprayer may be utilized, as are well known in the art.

If a spray system (30) is selected, such a system may allow for use with reusable pads (20), such as the microfiber pads (20) used with commercially available steam appliance (10). But the reusable pads (20) have the disadvantages disclosed herein. Thus a spray system (30) may be advantageously used with a single-use floor sheet (20), which is discarded after one cleaning event. If spray is used it will be advantageous to use dry absorbent pads (20) such those described and referenced herein by U.S. Pat. Nos. 6,716,805 B1, 7,420,656 B2, 7,163,349, 6,101,661, and 7,144,173.

Prophetically, the spray system (30) may spray a first active onto the floor. The floor sheets (20) may contains a second active, which becomes efficacious upon contact with and wetting by the first active. This embodiment provides the benefit that two, or more, incompatible materials may be combined at the point of use to create a particularly efficacious cleaning solution.

If desired, the system may comprise a single steam generating appliance (10) and a plurality of floor sheets (20). The floor sheets (20) may comprise identical or different laminate constructions. Likewise the floor sheets (20) may comprise identical or different cleaning solutions. Likewise the sheets may comprise of different solution load factors. This arrangement provides the benefit that the user may select a floor sheet (20) particularly suited for a given cleaning task.

Figure 3:
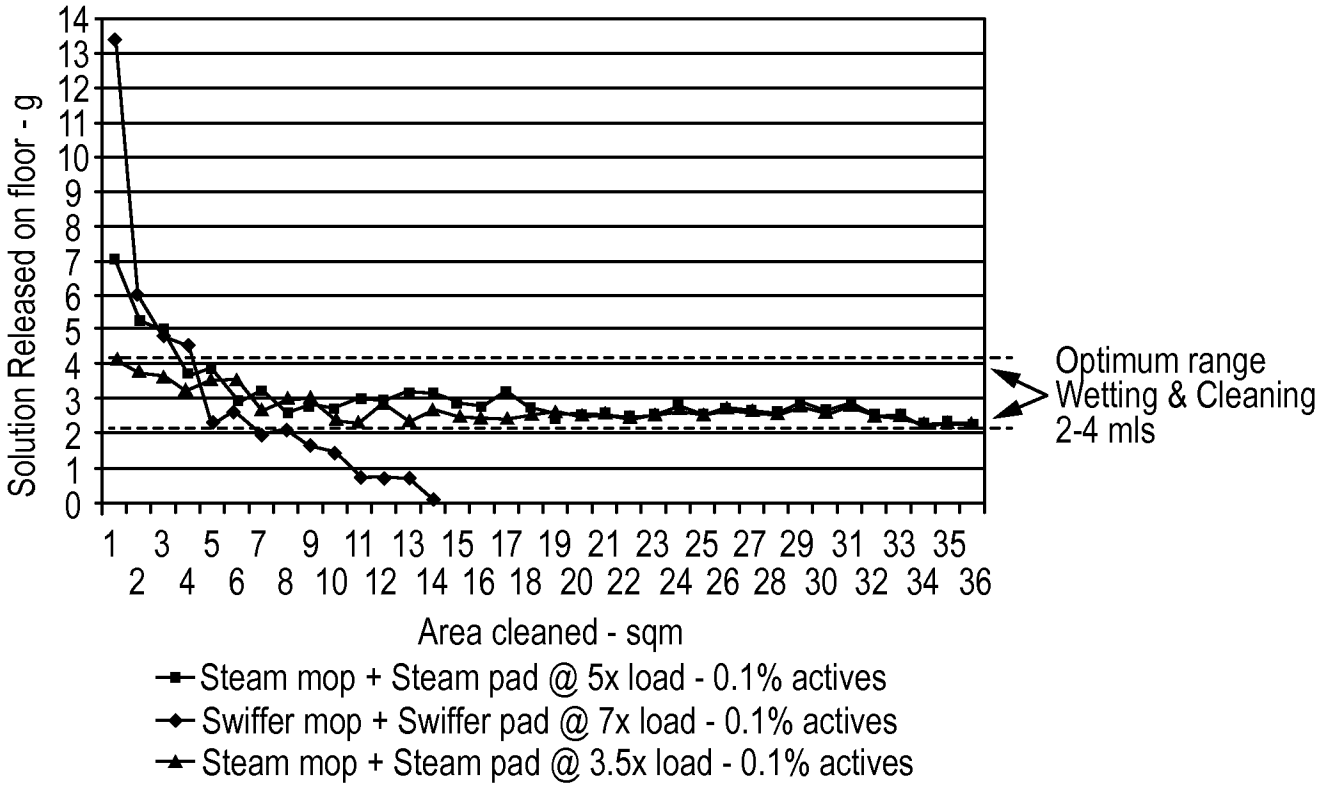
FIG. 3 is a graphical representation of the amount of solution released during cleaning for cleaning systems according to the prior art and according to the present invention.

Referring to FIG. 3, various systems were tested for release profiles. FIG. 3 includes: 1) a Swiffer Wet floor sheet (20), commercially available in May, 2012 and used as a control; and 2) two steam appliances (10) using pre-wetted floor sheets (20), one floor sheet (20) having a 3.5× load factor and one floor sheet (20) having a 5× load factor. All cleaning solutions had 0.1 weight percent of identical actives.

The test method utilized a floor having 30.5×30.5 cm black ceramic tiles with 0.64 cm wide grout lines. A pad (20) to be tested was pre-weighed before use and attached to a Swiffer Sweeper implement, sold by the instant assignee. The pad (20) was then wiped across a one sqm floor area then re-weighed. The amount of solution released onto floor was determined by subtracting original pad (20) weight from pad (20) weight after cleaning 1 sqm. This process was repeated over several cycles until the pad (20) could no longer release enough solution to uniformly wet, based on visual determination, the entire 1 sqm of floor area. Tests were run with 3 replicates.

Figure 4:
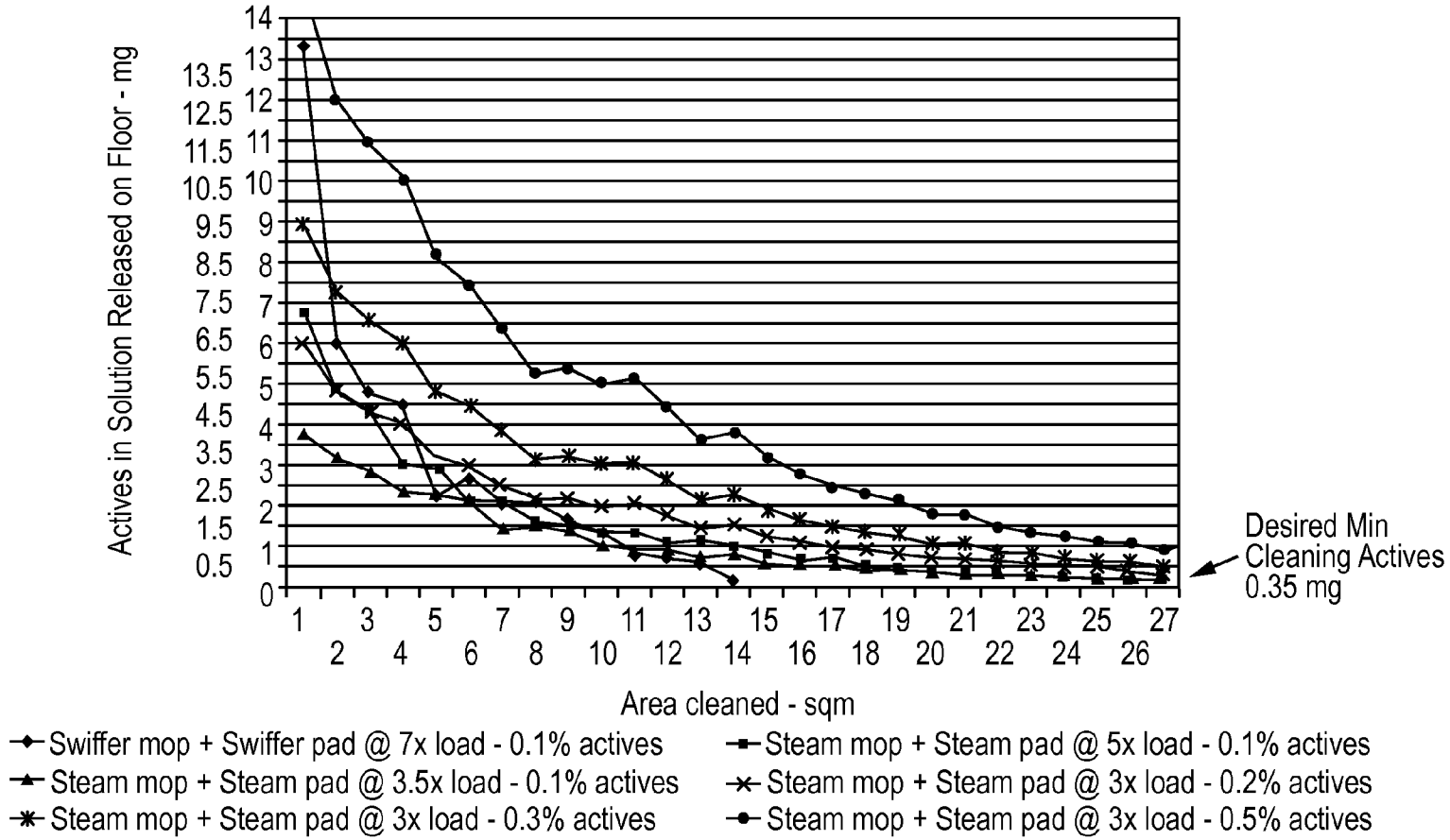
FIG. 4 is a graphical representation of the amount of actives released during cleaning for cleaning systems according to the prior art and according to the present invention.

FIGS. 3-4 describe cleaning in terms of liquid released to the floor and amounts of non-volatile cleaning actives delivered to floor, taking into account water dilution. These measurements assume that the non-volatile actives are 100% water soluble and that none of these actives stick to the pad (20).

Applicants have unexpectedly found a uniform application rate of 2-4 mls/sqm provides optimum cleaning over greater and lesser amounts of cleaning solution. The data in FIG. 3 show that a prior art Swiffer Wet floor sheet (20) can clean about 9 sqm before the amount of cleaning solution expressed onto the floor becomes less than 2 mls/sqm and starts to become inadequate to uniformly wet the floor. The Swiffer Wet floor sheet (20) delivered the 2-4 ml/sqm desired dosing for about 6 out of 9 sqm of total area cleaned.

The results indicate that for at least a portion of a typical floor cleaned with a Swiffer Wet floor sheet (20), inconsistent cleaning performance may result. Inconsistent cleaning performance can include a sticky floor, slower drying, potential for more floor damage through excess solution and visually more haze from excess non-volatile cleaning agents left behind.

The data in FIG. 3 also show that a Swiffer Wet floor sheet (20) expresses almost one-fourth of the total cleaning solution pre-wetting that pad (20) during the first 1 sqm of floor area cleaned. I.e. this first sqm may receive more than 3 times the desired amount of cleaning solution. This initial loading onto the first portion of the floor to be cleaned, also limits the amount of non-volatile cleaning actives that can be added to a Swiffer wet floor sheet (20). While greater amounts of cleaning actives could be advantageous at the 2 to 4 ml dosing level, an increase in actives could be very undesirable during the first approximately 1 sqm of cleaning where dramatic solution dumping occurs.

FIG. 3 further shows a comparison of solution release when the Swiffer Wet type floor sheets (20) are used in combination with a steam appliance (10). The difference is the Swiffer wet floor sheet (20) was pre-dosed with steam for about 20 seconds and then weighed to determine the total of cleaning solution and hot water added by the condensed steam. This hot pad (20) is then wiped onto floor and the difference is measured between tare weight and after wiping each 1 sqm.

This wetness replenishment delivered via steam condensing to water, unexpectedly provides a very uniform wetness release profile from the pad (20) to the floor. FIG. 3 shows that a pre-moistened pad (20) at 5× loading and at 3.5× loading unexpectedly delivers the optimum fluid delivery target of 2-4 mls/1 sqm to the floor for up to 36 sqm.

This area represents approximately 4 times the area cleaned by a prior art Swiffer Wet floor sheet (20). The improvement is even more significant when one considers the prior art Swiffer Wet floor sheet (20) floor has a 7× pre-wetted load factor—higher than the load factor used with steam. Importantly, by lowering the load factor to 3.5×, the steam pad (20) can virtually eliminate the dumping phenomenon observed with pre-moistened floor sheets (20) according to the prior art. The prior art floor sheets (20) may be oversaturated, to compensate for trying to increase total cleaning area.

While delivering the optimal solution profile of 2-4 mls/sqm to floor is ideal for optimum cleaning, one of skill may consider that the cleaning actives in the cleaning solution are typically water soluble. As such while steam replenishes lost wetness via re-wetting with condensed water, the amount of cleaning actives delivered to floor become diluted. While it may be desirable to lower the initial load factor of a pre-moistened pad (20) used with a steam appliance (10), it may be desirable to increase the amount of cleaning actives to compensate for the diluting affect of the steam in order to maintain effective cleaning efficacy for one pad (20) over larger area of cleaning.

FIG. 4 shows a comparison of amount of non-volatile cleaning actives in mg actually delivered to the test floor per each sqm. Recall FIG. 3 shows that enough solution can be delivered using steam appliance (10) to replenish a pre-moistened pad (20) for over 36 sqm. But FIG. 4 shows that the optimally cleaned area is likely closer to 27 sqm when one accounts for both ideal liquid deposition of 2-4 mls/sqm and adequate delivery of minimum amount of non-volatile cleaning actives (0.35 mg) to aide in wetting floor and minimizing de-wetting. The 27 sqm is approximately triple the area that could be cleaned with a prior art Swiffer Wet floor sheet (20) using the standard prior art Swiffer Sweeper. Thus, the desired amount of cleaning active applied to each sqm of floor surface may be at least 0.25, 0.3 or 0.35 mg, and less than 0.5, 0.4.5 or 0.4 mg.

Based on these data, a desirable floor sheet (20) for use with a steam appliance (10) may have a load factor ranging from about 2× to 5×, or 3× to 4× grams of cleaning solution per gram of dry pad (20) and from about 0.1 to about 0.5 w % or 0.2 to 0.4 w % non-volatile cleaning actives.

Pads (20) with these load factors being lower than typically found in the art, combined with the aforementioned amounts of non-volatile cleaning actives are judged unsuitable for use with a Swiffer Wet floor sheet (20) and Swiffer Sweeper mop having no steam. Conversely, a prior art commercially available Swiffer Wet floor sheet (20) would too wet to be effectively used as a floor sheet (20) for a steam appliance (10). The over-saturation at 7× load factor would lead to consumer negatives and inconsistent performance. Thus one of skill must match the load factor and optionally the actives to the system, to obtain advantageous cleaning performance.

As noted above, floor cleaning may use a system that can clean everyday particulate soils without leaving streaks as well as removing less frequently occurring stains, which are often more difficult to clean. Such stains may be difficult to clean, in part due to the range of soil types particularly occurring in the kitchen area. Some of these stains may comprise primarily individual components such as grease from frying, and sugary soils such as from jam, honey, syrup and the like.

Greasy soils are often better removed by cleaning chemistry, such as surfactants than by steam or hot water. Difficulty removing greasy soils may be particularly noticeable when the grease has polymerized, making it harden and emulsify. Surfactants lower surface tension of the surrounding water, so that it is less likely to stick to itself and more likely to interact with oil and grease. This wetting allows surfactant containing water solution greater grease penetration, and then dispersion, making it easier to break up and remove the grease. While hot steam is more effective than tepid water at removing grease via being able to softening and melting it, hot steam still cannot create the emulsification attributes provided by surfactants.

Similarly high sugar containing soils can harden, making the stain quite sticky and tacky. On these types of soils, steam can be more advantageous than cleaning chemistry by having higher efficacy in dissolving sugar. Sugar typically dissolves in water by colliding with water molecules which breaks down the sugars chemical bonds. When water is heated, the molecules move faster such that the force of collisions between water and sugar increases. providing for faster dissolution of the sugar. Table 1 below shows that temperatures which approach boiling water (steam) achieve almost six times more solubility of sugar compared to room temperature water.

TABLE 1

| Temperature | Solubility in grams of glucose per 100 mL of water |
|---|---|
| 25° C. | 91 |
| 30° C. | 125 |
| 50° C. | 244 |
| 70° C. | 357 |
| 90° C. | 556 |

Thus, a prior art steam appliance (10) using water with a microfiber pad (20) can remove high sugar containing soils. But these systems can be inefficacious for soils having relatively high grease levels. Conversely, a prior art chemical cleaning mop can efficaciously clean greasy soils. But these systems can be inefficacious for soils having relatively high sugar levels.

In situations where there are mixed soils containing high levels of sugar, grease and other components such as protein, both the prior art steam appliance (10) and the prior art chemical cleaning system will be challenged and likely inefficacious. Table 2 below shows examples of tough stain cleaning ability of different systems. These examples include: Example 1—Market leading prior art steam appliance (10) from Shark, Example 2 The invention steam appliance (10) used with a dry pad (20) containing no chemistry, Example 3—Invention steam appliance (10) used with a pre-moistened pad (20) without steam and Example 4 Invention steam appliance (10) used with a pre-moistened pad (20) containing a cleaning solution and steam. The data in Table 2 shows that on a high sugar soil (uncooked tomato sauce) all the systems remove the soil about the same.

Table 2 shows that for a mixed soil containing sugar, grease and protein (such as peanut butter), the steam alone used in Examples 1 and Examples 2 are ineffective at easily removing this soil. Example 3, which uses chemistry with steam, is only marginally better, likely due to ability of chemistry to emulsify greasy components in peanut butter. Example 4 which combines steam and cleaning solution chemistry demonstrates the unexpected synergistic benefits of cleaning this mixed soil. Furthermore this unpredicted benefit occurs with 3 to 5 times less strokes than all the other systems tested.

TABLE 2

| Soil | | Example 1 | Example 2 | Example 3 | Example 4 |
|---|---|---|---|---|---|
| | Device | Shark Steam Mop | Invention Steam Mop | Invention Steam Mop | Invention Steam Mop |
| | Pad | MF | Swiffer Pad Dry | Swiffer Pad Pre-moistened | Swiffer Pad Pre-moistened |
| | Steam | Yes | Yes | No | Yes |
| | Chemistry | No | No | Yes | Yes |

TABLE 2-continued

| Soil | | | Example 1 | Example 2 | Example 3 | Example 4 |
|---|---|---|---|---|---|---|
| High Sugar Soil | Tomato Sauce | # strokes to clean | 7 | 7 | 8 | 5 |
| | | Visual Result | left some residue | left some residue | | |
| Mixed Soil Sugar + Grease + Protein | Peanut Butter | # strokes to clean | 20 | 30+ | 17 | 5 |
| | | Visual Result | left residue | left residue | | |

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm" It should be understood that every maximum numerical limitation given throughout this specification includes every lower numerical limitation, as if such lower numerical limitations were expressly written herein. Every minimum numerical limitation given throughout this specification includes every higher numerical limitation, as if such higher numerical limitations were expressly written herein. Every numerical range given throughout this specification includes every narrower numerical range that falls within such broader numerical range, as if such narrower numerical ranges were all expressly written herein.

All parts, ratios, and percentages herein, in the Specification, Examples, and Claims, are by weight and all numerical limits are used with the normal degree of accuracy afforded by the art, unless otherwise specified.

Except as otherwise noted, the articles "a," "an," and "the" mean "one or more." All documents cited in the Detailed Description of the Invention are, in relevant part, incorporated herein by reference; the citation of any document is not to be construed as an admission that it is prior art with respect to the present invention. To the extent that any meaning or definition of a term in this written document conflicts with any meaning or definition of the term in a document incorporated by reference, the meaning or definition assigned to the term in this written document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A system for cleaning a hard target surface, said system comprising: a steam generating appliance, said appliance having a sole plate for removably attaching a cleaning pad thereto;

a cleaning pad removably attachable to said sole plate; and a cleaning solution, said cleaning solution being applicable to the target surface with steam from said appliance at 2 to 4 mls/square meter.

2. A system for cleaning a hard floor, said system comprising: a steam generating appliance;

said appliance having a sole plate for removably attaching a floor sheet thereto, a floor sheet removably attachable to said sole plate; and a cleaning solution, said cleaning said cleaning solution being dispensable to the floor from said appliance or from said floor sheet at 2 to 4 mls/square meter.

3. A system according to claim 2 wherein said appliance further comprises a sprayer, for spraying said cleaning solution onto the floor.

4. A system according to claim 3 wherein said cleaning solution comprises 0.04 to 0.5 weight percent agglomerating polymer and 0.02 to 0.25 weight percent surfactant.

5. A system according to claim 4 wherein said floor sheet comprises nonwoven material.

6. A system according to claim 5 wherein said floor sheet comprises a laminate construction, having at least two layers.

7. A system according to claim 5 wherein said floor sheet comprises a laminate construction having three layers, at least two of said layer comprising nonwoven material.

8. A system for cleaning a hard floor, said system comprising: a steam generating appliance;

said appliance having a sole plate for removably attaching a floor sheet thereto, a pre-wetted floor sheet removably attachable to said sole plate, said floor sheet being pre-wetted with a cleaning solution; and a cleaning solution impregnated in said floor sheet at a loading of 3 to 5 grams of cleaning solution per gram of floor sheet, said cleaning solution being dispensable to the floor with steam from said appliance.

9. A system according to claim 8 wherein said cleaning solution is aqueous.

10. A system according to claim 9 wherein said cleaning solution consists of tap water.

11. A system according to claim 8 wherein said cleaning solution comprises components selected from the group consisting of zwitterionic polymers, agglomerating polymers, surfactants and combinations thereof.

12. A system according to claim 11 wherein said cleaning solution comprises a polyacrlamide agglomerating polymer.

13. A system according to claim 12 wherein said polyacrlamide agglomerating polymer comprises from 0.04 to 0.5 weight percent of said cleaning solution.

14. A system according to claim 13 wherein said cleaning solution comprises 0.02 to 0.25 weight percent surfactant.

15. A system according to claim 2 wherein said floor sheet further comprises a cleaning solution disposed on said sheet in dry form.

16. A system according to claim 15 wherein said dry cleaning solution comprises 0.02 to 0.2 grams of surfactant disposed on said floor sheet.

17. A system according to claim 16 wherein said dry cleaning solution comprises 0.02 to 0.5 grams of agglomerating polymer disposed on said floor sheet.

* * * * *